US005572886A

United States Patent [19]

Katz

[11] Patent Number: 5,572,886

[45] Date of Patent: Nov. 12, 1996

[54] THIN METAL FOIL JEWELRY

[76] Inventor: Ernest Katz, 1755 55th St., Brooklyn, N.Y. 11204

[21] Appl. No.: 328,653

[22] Filed: Oct. 25, 1994

[51] Int. Cl.[6] ..... A44C 25/00

[52] U.S. Cl. ..... 63/2

[58] Field of Search ..... 63/2; 29/160.6

[56] References Cited

U.S. PATENT DOCUMENTS

| | | | |
|---|---|---|---|
| 150,741 | 5/1874 | Barrows . | |
| 215,235 | 5/1879 | Miller . | |
| 488,630 | 12/1892 | Hafely . | |
| 625,959 | 5/1899 | Saart . | |
| 958,641 | 5/1910 | Heeren | 29/160.6 |
| 1,602,847 | 10/1926 | Dover . | |
| 1,808,920 | 6/1931 | Forstner . | |
| 1,971,700 | 8/1934 | August | 29/160.6 |
| 2,033,340 | 3/1936 | Kranz et al. . | |
| 2,540,522 | 2/1951 | Homerin . | |
| 2,947,058 | 8/1960 | Landells et al. . | |
| 3,667,098 | 6/1972 | Levy . | |
| 4,581,088 | 4/1986 | House | 63/2 |

FOREIGN PATENT DOCUMENTS

| | | | |
|---|---|---|---|
| 403140 | 10/1909 | France . | |
| 561380 | 1/1923 | France | 63/2 |
| 2252148 | 6/1975 | France | 29/160.6 |

*Primary Examiner*—Flemming Saether
*Attorney, Agent, or Firm*—Helfgott & Karas, PC.

[57] ABSTRACT

A thin metal foil jewelry formed of a thin planar foil of precious metal which includes peaks and valleys randomly intersecting and crossing each other with at least some of the peaks and valleys having bends of less than 90°. The overall jewelry has an arcuate shape to it. The presence of the peaks and valleys, with at least some of them being less than 90° and the arcuate shape of the jewelry provides a rigidity so that foil of between 0.002 and 0.025 inches can be utilized which foil typically cannot be used for this type of aesthetic deformations.

8 Claims, 2 Drawing Sheets

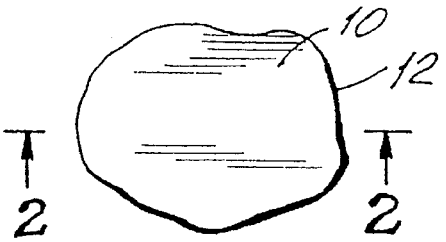
FIG.1
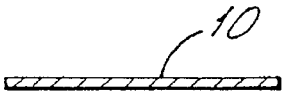
FIG.2
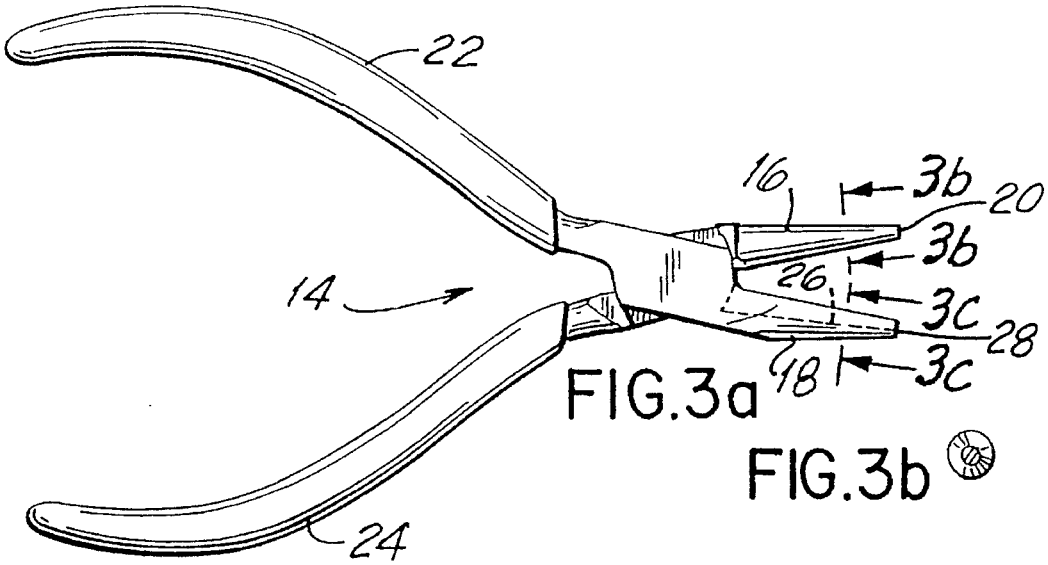
FIG.3a
FIG.3b
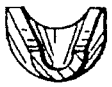
FIG.3c
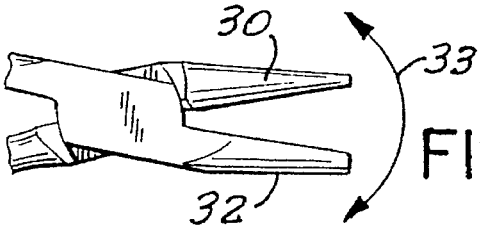
FIG.4
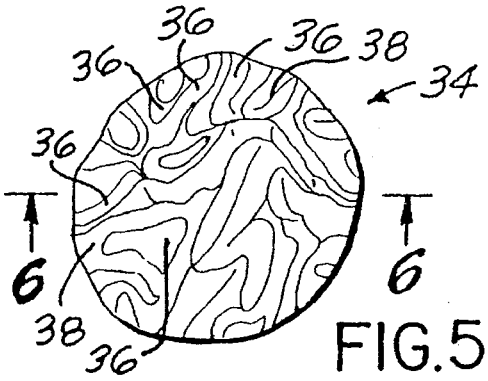
FIG.5
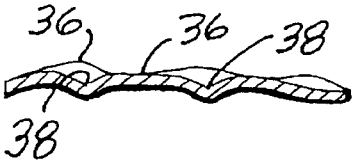
FIG.6

THIN METAL FOIL JEWELRY

BACKGROUND OF THE INVENTION

This invention relates to foil jewelry and a method of making foil jewelry and in particular to foil jewelry made from thin metal foil. The method permits thin metal foil which is normally too flexible to be used for jewelry to be shaped into unique designs, which designs impart rigidity and strength to the foil.

The jewelry industry is highly competitive and lower cost attractive jewelry is sought by the consumer. The price of jewelry made of precious metals is highly dependent on the metal weight of the final product. This has lead to the need to develop jewelry with less metal weight which has the look, strength and feel of jewelry with more weight.

One example of lowering the metal weight of jewelry is to form a hollow rope chain rather than solid rope chain. The hollow rope chain has up to 60 percent less metal than its solid counterpart, but with the look, feel and hardness of a solid rope chain. As the price of precious metals increases the need for attractive jewelry with less precious metal requirement increases.

This has prompted jewelry manufacturers to seek methods of creating jewelry that looks aesthetically similar to heavier products with similar strength characteristics. Therefore, by way of example in the gold jewelry industry reducing weight of gold is an important cost reduction goal. The problem has been that as the gold material is reduced in thickness to reduce its weight, the flexibility of the gold increases and the final product loses its rigidity.

What is needed is a thin precious metal piece of jewelry which has the look and feel of its heavier counterpart and a method of making the jewelry which assures a consistently rigid and strong product.

Typical prior art methods of making jewelry with various shapes include either stamping techniques or casting techniques. Using casting techniques, many arbitrary shapes can be achieved of just about any type of shape desired. This is achieved by forming a mold and from the mold forming a wax pattern. The wax pattern is then utilized to form the jewelry and the wax is melted out. This process is typically called a lost wax process. Using rubber molds, which typically can be bent, numerous shapes normally not achievable can be achieved, including bends of almost any angular shape.

However, when dealing with casting techniques, the thickness of the jewelry involved is rather substantial and as a result pieces cast from precious metals are typically heavy, cost a lot, and require a large amount of gold.

Other techniques that have been used to form jewelry pieces involve stamping techniques. Using a stamping process, thin sheets of gold can be utilized to form the piece of jewelry. However, using a stamping technique it is impossible to achieve bends of less than 90° (representing the measure of the space between the horizontal plane of the sheet of precious metal and the adjacent exterior surface of the crimped bend on both sides of such bend) since in a stamping technique the two parts mate one into the other and angles must be greater than 90° in order to permit the two parts to be extracted from each other.

As a result, using stamping techniques there are limits as to the style and design of shapes that can be made into the jewelry and specifically bends of less than 90° are not achievable.

SUMMARY OF THE INVENTION

Accordingly, it is an object of the present invention to provide an improved jewelry item made from thin metal foil which can achieve the benefits of costly jewelry.

Another object of the present invention is to provide a rigid, stable piece of jewelry from a thin planar foil.

A further object of the present invention is to provide a method of imparting shapes to a thin planar foil, which shaping strengthens the foil.

A still further object of the present invention is to provide a method of shaping a thin planar foil which includes finishing the edges of the foil to aesthetically improve appearance and add rigidity to the item.

Yet a further object of the present invention is to provide a rigid, piece of jewelry from a thin planar foil which includes peaks and valleys randomly intersecting and crossing each other with at least some of the peaks and valleys having bends of less than 90°.

In accordance with the present invention, there is provided an item of jewelry made of a thin piece of foil of precious material having a periphery. The foil includes a design which has peaks and valleys omnidirectionally formed by deforming the boil such that the peaks and valleys randomly intersect and cross each other. At least some of the peaks and valleys have angles of less than 90° measured between the horizontal plane of the thin foil and the adjacent exterior surface of the crimped bend on both sides of such bend. The foil includes intermediate peaks and valleys along the foil which interconnect and overlay other peaks and valleys omnidirectionally in the foil.

In an embodiment of the invention, the thin metal piece of foil has a closed periphery thereabout. In yet a further embodiment, the edges of the foil are melted to form a bead to add further rigidity to the foil and a different aesthetic appearance. In yet a further embodiment the edges of the foil are bent to form a skirt which can then receive a backing. Other embodiments include holes which are burnt or formed into the foil to create a beaded hole which adds rigidity to the foil and also changes its aesthetic appearance. In yet other embodiments, the surface can be sandblasted and then the piece is polished thereby giving a shiny finish to the peaks and a matte finish to the valleys.

By making the peaks and valleys having at least some of them with bends of less than 90°, the piece of jewelry attains a great rigidity despite the thinness of its foil material. Typically, by way of example, foil of less than 0.004 inches is utilized and jewelry even with foil of 0.002 inches have been successfully achieved. With this type of thin foil, it is normally impossible to achieve any rigidity. However, with the formed peaks and valleys crossing each other and with at least some of them having bends of less than 90°, sufficient rigidity is achieved even with the very thin metal foil to sustain a lasting piece of jewelry which is substantially reduced in cost because of the little precious metal utilized, and yet results normally obtained from heavy weight casting techniques can be achieved.

The aforementioned objects, features and advantages of the invention will, in part, be pointed out with particularity and will, in part, become obvious from the following more detailed description of the invention taken, in part, with the drawings which form an integral part thereof.

BRIEF DESCRIPTION OF THE DRAWINGS

In the drawings:

FIG. 1 is a top view looking down at a piece of metal foil with an arbitrary peripheral shape;

FIG. 2 is a cross-sectional view of the foil shown in FIG. 1, taken along line 2—2;

FIGS. 3*a*, 3*b* and 3*c* show a tool for fashioning the foil shown in FIG. 1 into a piece of jewelry;

FIG. 4 is a fragmentary view of another tool for fashioning jewelry;

FIG. 5 is a top view of the foil shown in FIG. 1 after having been randomly crimped;

FIG. 6 is a cross-sectional view of the foil shown in FIG. 5 taken along line 6—6;

In the various figures of the drawings like reference characters designate like parts.

DETAILED DESCRIPTION OF THE PREFERRED EMBODIMENT

Figure 7:
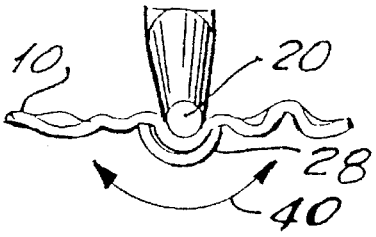
FIG. 7 is an end view of the jaws of the crimping tool shown in FIG. 3 engaging a piece of foil.

Referring now to the drawings, in FIG. 1 there is shown a thin metal foil generally designated as 10 having an arbitrary peripheral shape 12. The foil is made of a metal such as a precious metal which can be gold or the like, for the purposes of the description of the invention. As shown in cross-section in FIG. 2, the foil 10 is thin. The foil is in the range of 0.002 to 0.025 inches in thickness. A suitable thickness is one which can be easily shaped into a unique jewelry design with adequate rigidity and strength to withstand damage in ordinary use.

Although the present invention covers the particular article jewelry, there will be hereinafter described one method which can be used for making the particular articles of jewelry. However, it should be understood that the present invention covers the result which heretofore has not been achieved using the standard well known jewelry techniques and has now been achievable to produce an article of jewelry which is lightweight, made of exceedingly thin foil metal, which is rigid, and includes peaks and valleys randomly intersecting each other with at least some of them having angles of less than 90° (measured between the horizontal plane of the thin foil and the adjacent exterior surface of the crimped bend on both sides of such bend).

Referring to FIGS. 3*a*, 3*b* and 3*c*, one example of a crimping tool generally designated 14 is shown. The tool 14 is by way of illustration shown to be a plier with crimping jaws 16 and 18. Jaw 16 is a round core which is tapered and becomes progressively larger in circumference beginning at the right end 20 as one moves to the left toward handles 22 and 24. Jaw 18 has a semicircular trough 26 the bottom of which is shown dotted. Trough 26 becomes progressively larger in diameter beginning at the right end 28 as one moves to the left toward the handles 22 and 24 so that the tapered core 16 fits within the trough 26. As shown in FIG. 7, the right ends 20 and 28 of the tapered core 16 and the trough 28, respectively, nest within one another.

In practice, foil 10 is gripped by crimping jaws 16 and 18. Closing of the jaws by squeezing handles 22 and 24 of the plier 14 together causes a semicircular crimp in the foil as shown in FIG. 7. These initial crimps are randomly formed omnidirectionally by merely closing the plier multiple times on the foil in different places. By forming multiple crimps which overlap, the crimps lose their semicircular shape and take on random curves with peaks and valleys.

Referring to FIG. 4, an alternative pair of crimping jaws 30 and 32 are shown. The jaws are flat and are similar to those on needle nose pliers. Round jaws may also be used, but will impart a different aesthetic look to the foil. The initial crimps can also be made by jaws 30 and 32 by using an up and down rocking motion in the direction of arrows 33 to deform the foil and to render it non-planar. The invention will be described using the plier 14, with the pair of jaws shown in FIGS. 3 and 4, but other devices including a fully automated crimping device can be used.

Referring to FIG. 5, foil 34 has been initially crimped as described and has multiple peaks 36 and valleys 38.

Foil 34 shown in cross-section in FIG. 6, is still substantially planar. The initial crimps begin to add rigidity and stability to the foil 34. In addition, the peaks and valleys are randomly dispersed and interim peaks and valleys are formed omnidirectionally between other peaks and valleys, resulting in unique designs.

In order to complete the design and to further add rigidity to the foil, the jaws 20 and 28, or 30 and 32, are again randomly placed over existing crimps and closed. However, this time, with the jaws closed as shown in FIG. 7, the plier is twisted in the directions of the arrows 40. The twisting creates new crimps and bends in the foil which overlay and randomly intersect with the previously formed peaks and valleys and in addition causes the foil 34 to assume an arcuate shape rather than the substantially planar shape.

Figure 8:
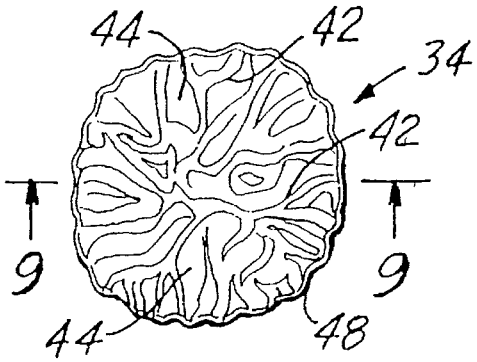
FIG. 8 is a top view of a completed jewelry design made in accordance with the process of the present invention.

Referring to FIG. 8, foil 34 which has been processed by both the initial crimping step of FIG. 5 as well as the crimping and twisting step, now has peaks 42 and valleys 44 with fairly sharp high points and low points so that the peaks and valleys resemble creases in the foil. At least some of those peaks and valleys have bends less than 90°. The walls coming off the peaks are often steep. These more pronounced peaks and valleys render the foil 34 much more rigid and stable. As viewed in cross-section in FIG. 9, foil 34 is now arcuate with the high point 46 in the vicinity of the mid-point and having a bend less than 90°. Similarly, peaks 46' and 46" have such less than 90° bends. Likewise, some of the valleys 47, 47' and 47" have bends less than 90°.

It will be noted that in this type of jewelry, there can be both peaks and valleys of less than 90°. As the peaks go upward and the valleys go downward, it will be noted that it is possible to create 90° bends in both opposing directions.

The presence of these peaks and valleys, especially with at least some of them being less than 90°, provides substantial rigidity to the very thin foil which otherwise would be flimsy and not be able to sustain itself, much less form a substantial piece of jewelry. Furthermore, because of the peaks and valleys, it is possible to simulate a cast piece of jewelry providing shapes normally not attainable unless very thick pieces of gold are cast into the particular shapes.

Figure 9:
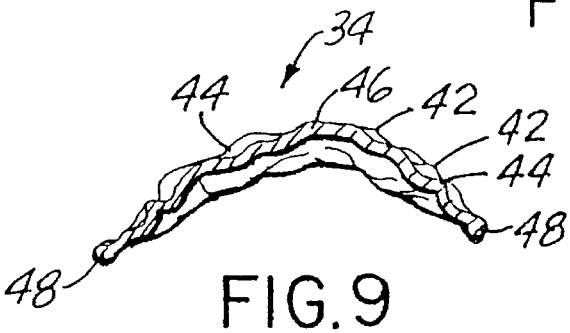
FIG. 9 is a cross-sectional view of the item of jewelry shown in FIG. 8, taken along line 9—9.

The arcuate shape also adds to the rigidity of the foil and renders it quite resistant to deformation and damage. Also, the arcuate shape is quite pleasing to the eye. The shaped foil 34 as shown in FIGS. 8 and 9 may be used as jewelry at this point. Shaped foil 34 with appropriate attachments could be an earing, a pin or part of a necklace.

The foil 34 can be further finished by heating the periphery to melt the outer edge so that a smooth bead 48 is formed. The bead 48 is thicker than the foil and imparts further rigidity and strength to the foil as well as a different look. The melting of the edge also provides for an irregular perimeter which also provides for a more aesthetic appearance. It should be noted, however, that the periphery of the article is a closed periphery.

Figure 10:
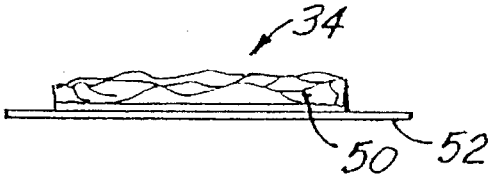
FIG. 10 is a piece of jewelry with a skirt formed to facilitate attachment to a backing.
Figure 11:
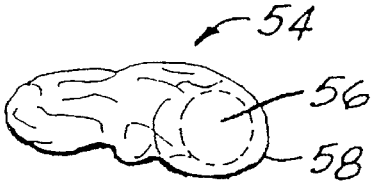
FIG. 11 is a piece of jewelry made in accordance with the invention and having a flat surface for receiving a stone.

Alternatively, as shown in FIG. 10, the foil 34 can have the edge bent downward to form a skirt 50. The skirt 50 can be used to attach the foil 34 to a backing 52 for additional support. The backing should preferably be of a thicker material. As shown in FIG. 11, a foil 54 can be finished with an unbent flat area 56. The flat area 56 can then be used to mount a stone such as a hemispherical pearl (not shown). To secure the stone all that need be done is to bend the edge 58 of the foil 54 to retain the stone. This provides secure retention without the need of forming a pronged seat.

Figure 12:
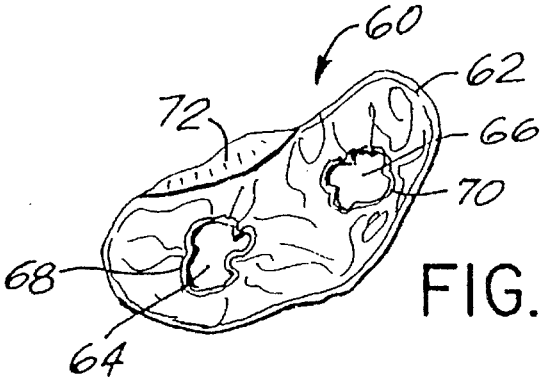
FIG. 12 is another design made in accordance with the present invention.

Another technique for adding beauty to the article of jewelry is shown in FIG. 12. The foil 60 has a beaded periphery 62 as before. In addition holes 64 and 66 are burned into the foil. The edges 68 and 70 of the holes also become beaded and irregular in the process and add rigidity to the foil and a different look. In addition an accent piece 72 such as a silver strip yellow gold, white gold or the like, can be adhered to the foil.

Figure 13:
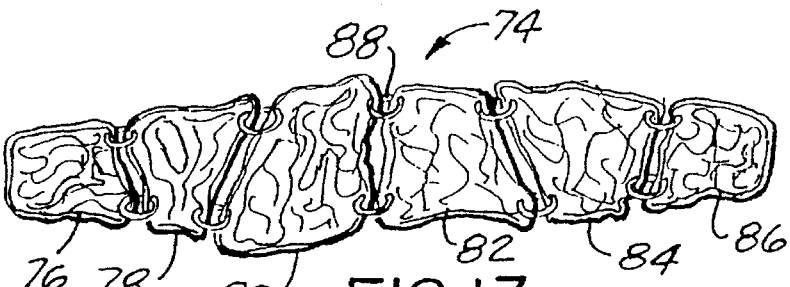
FIG. 13 is a bracelet made in accordance with the present invention.

A bracelet 74 consisting of finished foil pieces 76 through 86 is shown in FIG. 13. The pieces are drilled to have small holes (not shown) through which connecting rings 88 are inserted to link the foil pieces. Foil pieces 76 and 86 are fitted with a clasp (not shown) for holding the bracelet on a wrist.

There are many alternative finishing steps which could be taken. Examples of such steps are sand blasting the entire piece and then polishing the peaks. This gives a shiny nugget finish to the peaks and a matte finish to the valleys. The presence of the bends less than 90° enhances a possibility of distinguishing between the shiny and matte finishes. With some shallow bends, the sand blasting might occur even within shallow grooves. However, because of the deep grooves and sharp peaks, sand blasting can be distinguished between the peaks and valleys whereby portions are shiny and others are matte.

There has been described a preferred embodiment of the invention. However, it should be understood that various changes and modifications may be made thereto without departing from the spirit and scope of the invention.

What is claimed is:

1. An item of jewelry, comprising:

a thin metal piece having a surface worked from a planar portion of thin foil having a first closed periphery to a shape having a second periphery;

said surface having first peaks and valleys randomly formed omnidirectionally to randomly intersect and cross each other and said surface having intermediate second peaks and valleys randomly formed omnidirectionally to overlay said first peaks and valleys and randomly interconnecting with the first peaks and valleys.

2. An item of jewelry according to claim 1 wherein:

said piece has a generally arcuate shape over which the peaks and valleys are dispersed.

3. An item of jewelry according to claim 2 wherein the second periphery has been melted to form an irregular periphery with a bead therearound.

4. An item of jewelry according to claim 2, wherein the second periphery is bent to form a skirt for attachment to a backing.

5. An item of jewelry according to claim 1, further comprising a hole burned through the surface, the edge of the hole having an irregular shape and a thickened bead.

6. An item of jewelry according to claim 1 further comprising:

means for interconnecting to at least one other similar item of jewelry.

7. An item of jewelry according to claim 1 wherein said planar portion has a thickness in the range of 0.002 to 0.025 inches.

8. An item of jewelry according to claim 1 wherein peaks are shiny and valleys are matte.

* * * * *